US006398401B1

(12) United States Patent
Arceneaux

(10) Patent No.: US 6,398,401 B1
(45) Date of Patent: Jun. 4, 2002

(54) QUICK-MIX CEMENT MIXING AND DISPENSING BAG

(76) Inventor: Joseph G. Arceneaux, 309 S. Elm, Junction City, LA (US) 71749

( * ) Notice: Subject to any disclaimer, the term of this patent is extended or adjusted under 35 U.S.C. 154(b) by 0 days.

(21) Appl. No.: 09/537,366

(22) Filed: Mar. 29, 2000

(51) Int. Cl.[7] ..... B01F 11/00

(52) U.S. Cl. ..... 366/1; 366/130; 222/107; 383/16; 383/41

(58) Field of Search ..... 366/1, 130; 222/107; 383/16, 72, 906, 41

(56) References Cited

U.S. PATENT DOCUMENTS

| | | | | |
|---|---|---|---|---|
| 1,378,607 | A | * | 5/1921 | Norton |
| 1,459,599 | A | * | 6/1923 | Minor |
| 2,092,444 | A | * | 9/1937 | Dennery |
| 2,497,325 | A | * | 2/1950 | Scherba |
| 3,860,219 | A | * | 1/1975 | Nickerson, Jr. |
| 4,205,765 | A | | 6/1980 | May |
| 5,090,597 | A | | 2/1992 | Johnson |
| 5,222,630 | A | | 6/1993 | Burtis |
| 5,366,116 | A | | 11/1994 | Burtis |
| 5,618,105 | A | * | 4/1997 | Baker |
| 5,632,416 | A | | 5/1997 | Lane, Jr. et al. |
| 5,647,511 | A | | 7/1997 | Bond |

FOREIGN PATENT DOCUMENTS

| | | |
|---|---|---|
| WO | WO 89/00884 | 2/1989 |

* cited by examiner

*Primary Examiner*—Charles E. Cooley
*Assistant Examiner*—David Sorkin
(74) *Attorney, Agent, or Firm*—Lisa D. Velez

(57) ABSTRACT

A quick-mix cement mixing and dispensing bag comprising a flexible tubular structure which is lightweight and waterproof. The flexible tubular structure includes an inlet end having a topside and a bottom-side where the topside has a V-shaped notch formed therein. A central portion succeeding and integral with the inlet end and having a topside belly. An outlet end having a circumferentially tapering tubular profile and which succeeds and is integral with the central portion.

15 Claims, 3 Drawing Sheets

QUICK-MIX CEMENT MIXING AND DISPENSING BAG

TECHNICAL FIELD

The present invention relates to cement mixing and dispensing bags and, more particularly, to a quick-mix cement mixing and dispensing bag which is arranged and constructed to enhance the control of cement mixing and dispensing.

BACKGROUND OF THE INVENTION

Oftentimes, cement is mixed in a wheel barrel which provides a structured cavity capable of containing powered cement and water. One of the biggest drawbacks with the use of a wheel barrel is the amount of strength required to mix, with a stick, paddle or the like, the heavy and viscous cement. As can be appreciated, the necessary strength to accomplish the mixing of a 20 lb. bag of cement is significantly less than that which is required for an 80–100 lb. bag. Furthermore, it takes at least 10 minutes to mix the cement to a homogenous consistency. It is my experience that mixing cement in a wheel barrel if both time consuming and laborious. Additionally, a wheel barrel is not easily transportable and may not be readily available. PCT 89/00884 issued to Kurt Erikkson, entitled "MIXING DEVICE" discloses a mixing device comprising a tubular member which in one embodiment has two open ends and end handles. During mixing the end handles are lifted.

As will be seen from the disclosure below, there is a continuous need for a quick-mix cement mixing and dispensing bag which, when used, is easy to manipulate and control to achieve rapidly a homogenous cement mixture.

SUMMARY OF THE INVENTION

The preferred embodiment of the quick-mix cement mixing and dispensing bag of the present invention solves the aforementioned problems in a straight forward and simple manner.

Broadly, what is provided is a cement mixing and dispensing bag comprising a flexible tubular structure wherein said flexible tubular structure comprises: (a) an inlet end having a topside and a bottom-side wherein said topside has a notch formed therein which extends a significant portion along a length of said topside; (b) a central portion succeeding and integral with said inlet end and having a belly; and, (c) an outlet end having a tubular profile and which succeeds and is integral with said central portion wherein said tubular profile has a diameter which is smaller than a circumference of said inlet end.

Additionally, what is provided is a cement mixing and dispensing bag comprising a flexible tubular structure wherein said flexible tubular structure comprises: (a) an inlet end having a topside and a bottom-side where said topside has a V-shaped notch formed therein; (b) a central portion succeeding and integral with said inlet end and having a belly; and, (c) an outlet end having a circumferentially tapering tubular profile and which succeeds and is integral with said central portion.

In view of the above, an object of the present invention is to provide a cement mixing and dispensing bag which includes a first handle, positioned at the outlet end, and a second handle, positioned at the inlet end.

Another object of the present invention is to provided a cement mixing and dispensing bag with a handle which includes a drawstring coupled about the outlet end.

A further object of the present invention is to provide a cement mixing and dispensing bag with a handle formed in a bottom-side of the inlet end.

It is a still further object of the present invention to provide a cement mixing and dispensing bag which is made of a lightweight and waterproof plastic sheet of material.

It is a still further object of the present invention to provide a cement mixing and dispensing bag which can be used to obtain a more homogenous cement mixture.

It is a still further object of the present invention to provide a cement mixing and dispensing bag having a topside notch, preferably V-shaped, which aids in the visual inspection of the central portion and belly to eliminate the guesswork in determining when a homogenous cement mixture is achieved.

It is a still further object of the present invention to provide a cement mixing and dispensing bag which enhances the control and manipulation of a relatively heavy viscous fluid such as a cement mixture.

Moreover, what is provided is a granular material mixing and dispensing bag comprising: (a) a flexible tubular structure having an inlet and an outlet and a V-shaped notch formed in said inlet, wherein said flexible tubular structure is defined by (i) a bottom-side center with a beginning and an end; and, (ii) a topside center wherein the distance between said bottom-side center and said topside center increases from said beginning for a predetermined distance and thereafter decreases in width to said end; and, (b) a front-end handle formed in said bottom-side defined by an oblong aperture perpendicular to said bottom-side center and in close proximity to said beginning.

In view of the above objects, it is a feature of the present invention to provide a cement mixing and dispensing bag which is simple to manufacture.

Another feature of the present invention is to provide a cement mixing and dispensing bag which is relatively simple structurally.

A further feature of the present invention is to provide a cement mixing and dispensing bag which is simple to use and control when mixing and pouring.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
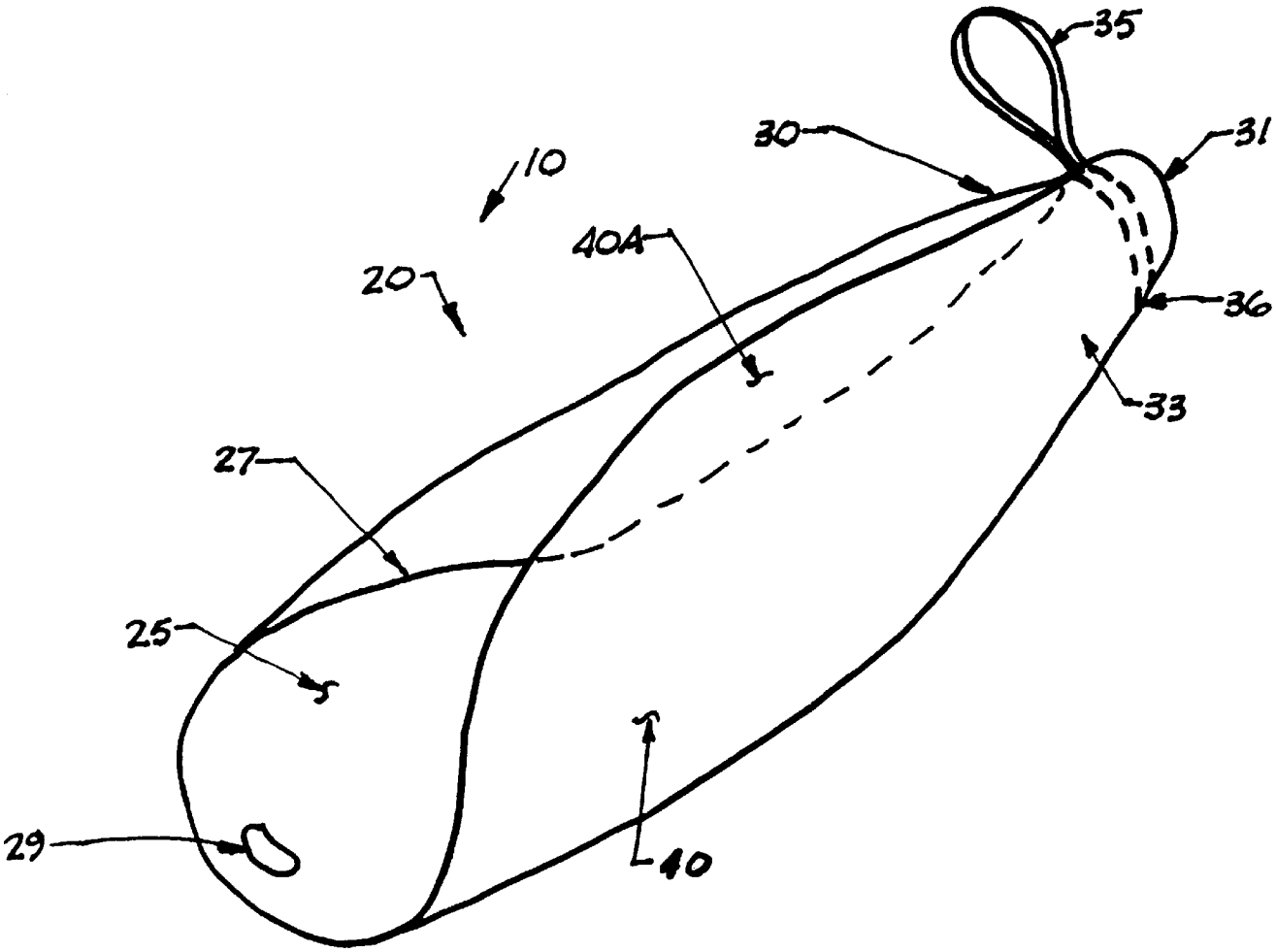
FIG. 1 illustrates a perspective view of the preferred embodiment of the quick-mix cement mixing and dispensing bag of the present invention.
Figure 2:
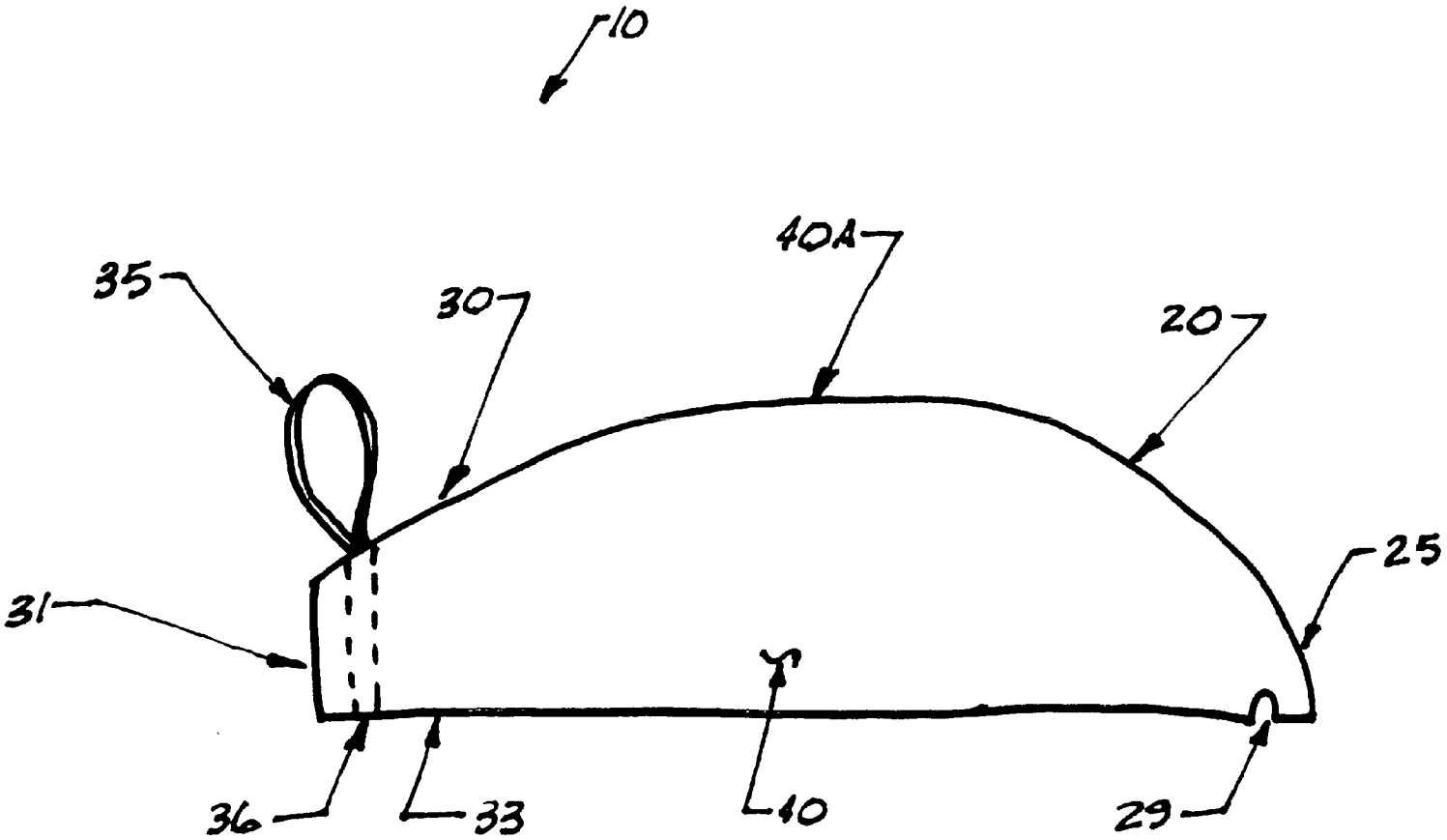
FIG. 2 illustrates a side view of the quick-mix cement mixing and dispensing bag from the center of the bottom-side thereof; and, FIG. 3 illustrates a side view of the quick-mix cement mixing and dispensing bag in use.
Figure 3:
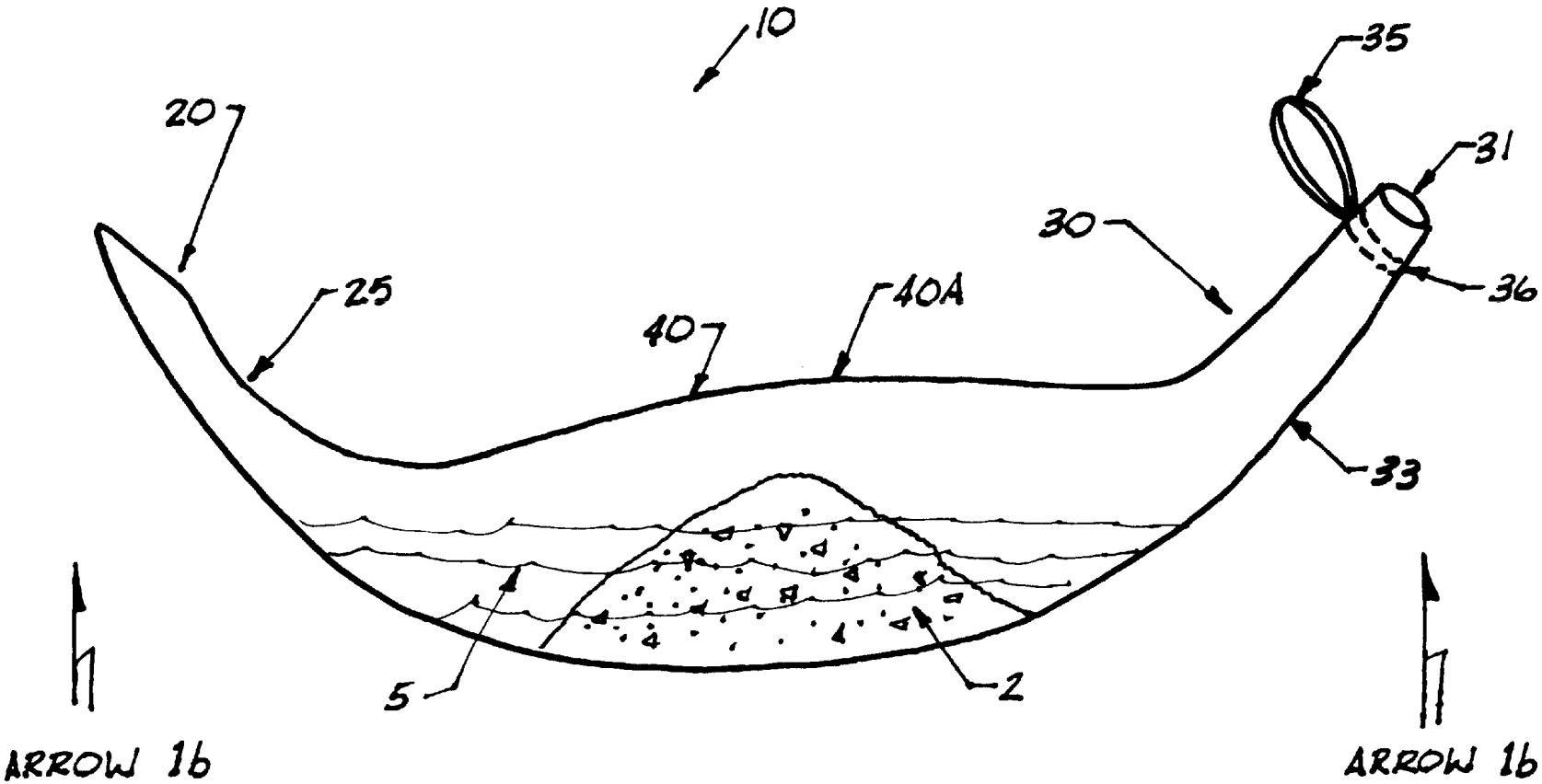

Referring now to the drawings, and in particular FIGS. 1–3, the quick-mix cement mixing and dispensing bag of the present invention is designated generally by the numeral 10.

The quick-mix cement mixing and dispensing bag 10 is, in general, comprised of a flexible tubular structure 20 having an inlet end 25, a narrowed outlet end 30 and a central mixing section 40 having a belly 40*a*. The cement mixing and dispensing bag 10 further includes a front-end handle 29 positioned at the inlet end 25. In the preferred embodiment, the front-end handle 29 comprises an oblong aperture formed in the bottom-side of said inlet end 25 in close proximity to the edge of the flexible tubular structure 20.

The narrowed outlet end 30 includes a tapering tubular channel 33 which proceeds the outlet opening 31. The narrowed outlet end 30 assists in better control during the pouring of the mixed cement through outlet opening 31. In the exemplary embodiment, the narrowed outlet end 30 further includes a handle 35. Handle 35 can be used alone or as a secondary handle which preferably is complemented with the tapered or narrowed contour of the tapering tubular channel 33. The general profile of the tapering tubular channel 33, as compared to the inlet end 25 and the central mixing section 40, can be easily placed in and gripped by one hand of the user to assist in lifting the rearend or outlet end of cement mixing and dispensing bag 10 while mixing and, especially, when pouring.

In the preferred embodiment, handle 35 is a drawstring assembly which would allow drawstring 36 to open and close the narrowed outlet end 30. As can be appreciated, during the mixing phase, if the drawstring 36 is closed then the outlet opening 31 is closed in that the size of the outlet opening 31 is further reduced as the result of gathering the fabric or material defining the outlet opening 31. Hence, the amount of liquid/water which would be lost in the event the narrowed outlet end 30 was dropped would be significantly reduced.

The overall design has significant advantages in that the reduction of material and streamline contouring allows the cement to be easily poured. In other words, the reduced tubular profile of the outlet end 30 enhances the manual manipulation of the heavy viscous fluid (cement) during pouring. Additionally, the reduced circumference of the narrowed outlet end 30 limits the amount of cement which can be poured to an amount which can be easily handled.

The inlet end 25 has a V-shaped notch 27 formed therein to allow the dry cement 2 to be placed directly into the belly 40*a* of central mixing section 40. Moreover, the V-shaped notch 27 also assists the user in pouring the water 5 directly in the belly 40*a* so that it is in direct contact with the dry cement 2. The V-shaped notch 27 allows the inlet end 25 to have a greater degree of variability in the size of a cement bag (not shown) it can receive. In other words, the inlet end 25 is not defined by a substantially continuous circumferential surface having a defined circumference. Instead, the V-shaped notch 27 allows an open bag of cement to be easily received so that the contents when poured fill belly 40*a* of the central mixing section 40. Additionally, the V-shaped notch 27 allows the fluid to be poured into the belly 40 where mixing is to take place.

The V-shaped notch 27 allows a bag of cement to be easily slipped in the inlet end 25 so that its contents can be readily poured into the belly 40*a* of the central mixing section 40. This is particularly advantageous since a bag of dry cement 2 changes dimensions rapidly because the cement granules, when dry, are easily shifted from one part of the bag to another under the force of gravity.

The V-shaped notch 27 also allows the interior of the central mixing section 40 and belly 40*a* to be easily inspected visually. Thereby, the user can readily determine when a homogenous cement mixture has been achieved to minimize pouring a poorly mixed heavy viscous fluid or cement. The advantage of which includes a higher quality structure made from a properly mixed (homogenous) cement mixture.

The quick-mix cement mixing and dispensing bag 10 has a unique profile which creates a belly 40*a* to mix therein the dry cement 2 and water 5. As can be appreciated, as the dry cement 2 and water 5 are received into the belly 40*a* of the central mixing section 40, the dry cement 2 and water 5 are, in general, not spread throughout the cement mixing and dispensing bag 10. Instead, the dry cement 2 and water 5 are maintained in the belly 40*a* of the central mixing section 40 when the inlet end 25 and the outlet end 30 are lifted in the direction of ARROWS 1*a* and 1*b*, as best seen in FIG. 3.

Referring still to FIG. 3, in the preferred embodiment, during operation the belly 40*a* should be positioned topside. Thus, as the cement 2 and water 5 are mixed, the cement 2 and water 5 can be rolled back and forth and side-to-side while the inlet end 25 and outlet end 30 are lifted until a homogeneous cement mixture is created.

As can be appreciated, mixing cement and, especially, 80–100 lbs. of powered cement without the need for a stick, paddle or any other device, suitable for stirring, significantly reduces the amount of expended energy. Additionally, the rolling action provides for a quicker mixing time since larger amounts of the cement are simultaneously subjected to agitation and mixing.

The flexible tubular structure 20 is made of a lightweight plastic sheet of material having a 14×14 mesh. The plastic sheet of material is adapted to be rolled and folded as would be cloth material. The plastic sheet of material is water impermeable. Thus, the flexible tubular structure 20 is essentially waterproof. Moreover, the slick surface of the plastic sheet of material can be easily cleaned of cement residue. Additionally, the slick surface allows the cement, a heavy viscous fluid, to be easily poured as it slides out of the outlet end 30.

In the exemplary embodiment, the approximate dimensions of the flexible tubular structure 20 include: (1) the inlet end 25 having a beginning circumference of 6 inches, an ending circumference of 19 inches and a length of 18 inches; (2) the narrowed outlet end 30 having a beginning circumference of 21 inches, an ending circumference of 10½ inches and a length of 26 inches; and, (3) a central mixing section 40 having a beginning circumference of 19 inches, an ending circumference of 21 inches and a length of approximately 30 inches. In general, preferably, the tubular channel 33 has a diameter which is smaller than the that of the inlet end 25.

In the preferred embodiment, the V-shaped notch 27 extends substantially the entire length of the inlet end 25. The dimensions set forth herein are preferred for up to 100 lb. bags of powered cement. Additionally, while the embodiment described herein is for cement, the cement mixing and dispensing bag 10 can be used with other granular materials requiring mixing with water or a fluid.

It is noted that the embodiment of the quick-mix cement mixing and dispensing bag described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A cement mixing and dispensing bag comprising:

a flexible tubular structure made of sheet material, said flexible tubular structure comprising:

an inlet end having a topside and a bottom-side, said topside having a notch formed therein extending a significant portion along a length of said inlet end;

a central portion succeeding and integral with said inlet end and having a belly;

an outlet end having a tubular profile and which succeeds and is integral with said central portion wherein said tubular profile has a circumference which is smaller than a circumference of said inlet end;

a first handle positioned at said outlet end, said first handle comprising a drawstring; and, a second handle positioned at said bottom-side of said inlet end, said second handle comprising an aperture formed through said sheet material.

2. The bag of claim 1, wherein said sheet material is made of plastic.

3. The bag of claim 1, wherein said flexible tubular structure is waterproof.

4. The bag of claim 1, wherein said belly is formed topside.

5. The bag of claim 1, wherein said tubular profile is defined by a circumferentially tapering tubular profile.

6. The bag of claim 1, wherein said inlet end has an ending circumference of approximately 19 inches and a length of approximately 18 inches;

wherein said outlet end has a beginning circumference of approximately 21 inches, an ending circumference of approximately 10½ inches and a length of approximately 26 inches; and, wherein said central portion has a beginning circumference of approximately 19 inches, an ending circumference of approximately 21 inches and a length of approximately 30 inches.

7. A cement mixing and dispensing bag comprising:

a flexible tubular structure made of sheet material, said flexible tubular structure comprising:

an inlet end having a topside and a bottom-side, said topside having a notch formed therein extending a significant portion along a length of said inlet end;

a central portion succeeding and integral with said inlet end and having a belly, said central portion for mixing dry cement and water to form cement;

an outlet end having a tubular profile and which succeeds and is integral with said central portion for dispensing said cement wherein said tubular profile has a circumferentially tapering tubular profile;

a first handle positioned at said outlet end, said first handle comprising a drawstring; and, a second handle positioned at said bottom-side of said inlet end, said second handle comprising an aperture formed through said sheet material.

8. The bag of claim 7, wherein said sheet material is made of plastic.

9. The bag of claim 7, wherein said flexible tubular structure is waterproof.

10. The bag of claim 7, wherein said belly is formed topside.

11. The bag of claim 7, wherein said inlet end has an ending circumference of approximately 19 inches and a length of approximately 18 inches;

wherein said outlet end has a beginning circumference of approximately 21 inches, an ending circumference of approximately 10½ inches and a length of approximately 26 inches; and, wherein said central portion has a beginning circumference of approximately 19 inches, an ending circumference of approximately 21 inches and a length of approximately 30 inches.

12. A mixing and dispensing bag for granular material comprising:

a flexible tubular structure made of sheet material, said flexible tubular structure comprising:

an inlet end having a topside and a bottom-side, said topside having a notch formed therein extending a significant portion along a length of said inlet end;

a central portion succeeding and integral with said inlet end and having a belly, said central portion for mixing said granular material, an outlet end having a tubular profile and which succeeds and is integral with said central portion for dispensing the mixed granular material wherein said tubular profile is a circumferentially tapering tubular profile;

a first handle positioned at said outlet end, said first handle comprising a drawstring; and, a second handle positioned at said bottom-side of said inlet end, said second handle comprising an aperture formed through said sheet material.

13. The bag of claim 12, wherein said sheet material is made of plastic.

14. The bag of claim 12, wherein said flexible tubular structure is waterproof.

15. The bag of claim 12, wherein said belly is formed topside.

* * * * *